US008524149B2

(12) United States Patent
Sato et al.

(10) Patent No.: US 8,524,149 B2
(45) **Date of Patent: *Sep. 3, 2013**

(54) NICKEL BASE WROUGHT ALLOY

(75) Inventors: Jun Sato, Hitachi (JP); Shinya Imano, Hitachi (JP); Hiroyuki Doi, Tokai (JP)

(73) Assignee: Hitachi, Ltd., Tokyo (JP)

( * ) Notice: Subject to any disclaimer, the term of this patent is extended or adjusted under 35 U.S.C. 154(b) by 140 days.

This patent is subject to a terminal disclaimer.

(21) Appl. No.: 12/728,292

(22) Filed: Mar. 22, 2010

(65) Prior Publication Data

US 2011/0058978 A1 Mar. 10, 2011

(30) Foreign Application Priority Data

Sep. 4, 2009 (JP) ..... 2009-204557

(51) Int. Cl.
*C22C 19/05* (2006.01)
*C22C 30/00* (2006.01)

(52) U.S. Cl.
USPC ..... 420/450; 420/445; 420/588

(58) Field of Classification Search
USPC ..... 420/446, 450, 445, 588; 148/410, 148/428
See application file for complete search history.

(56) References Cited

U.S. PATENT DOCUMENTS

| | | | | |
|---|---|---|---|---|
| 4,161,412 | A * | 7/1979 | Henry | 148/675 |
| 4,571,935 | A * | 2/1986 | Rice | 60/775 |
| 5,476,555 | A * | 12/1995 | Erickson | 148/410 |
| 5,788,785 | A * | 8/1998 | DeLuca et al. | 148/555 |
| 6,478,897 | B1 * | 11/2002 | Izumida et al. | 148/428 |
| 6,521,053 | B1 * | 2/2003 | Grylls et al. | 148/280 |
| 6,562,157 | B2 * | 5/2003 | Nonomura et al. | 148/677 |
| 2008/0085192 | A1 | 4/2008 | Fukuda et al. | |
| 2010/0310411 | A1 | 12/2010 | Ohsaki et al. | |

FOREIGN PATENT DOCUMENTS

| | | |
|---|---|---|
| EP | 1 065 290 | 1/2001 |
| EP | 1 410 872 | 4/2004 |
| EP | 2 050 830 | 4/2009 |
| JP | 9-272933 | 10/1997 |
| JP | 2004-256840 | 9/2004 |
| JP | 2008-88525 | 4/2008 |
| JP | 2009-97052 | 5/2009 |
| JP | 2009-191301 | 8/2009 |

OTHER PUBLICATIONS

Smith, G.D., "Future Trends in Key Nickel Alloy Markets", Nickel: A Century of Innovation, JOM, Sep. 2006, pp. 38-39.*

Choudhury, I.A et al.., "Machinability of nickel-base super alloys: a general review", Journal of Materials Processing Technology, 77 (1998), pp. 278-284.*

EP Search Report of Appln. 10157795.5 dated Dec. 28, 2010 in English.

Communication mailed May 28, 2013, in connection with Japanese Application No. 2012-098422; 2 pages; Japanese Patent Office; Japan.

* cited by examiner

*Primary Examiner* — Jessee R. Roe

(74) *Attorney, Agent, or Firm* — Antonelli, Terry, Stout & Kraus, LLP.

(57) ABSTRACT

A nickel base alloy includes: by mass, 0.001 to 0.1% of carbon; 12 to 23% of chromium; 15 to 25% of cobalt; 3.5 to 5.0% of aluminum; 4 to 12% of molybdenum; 0.1 to 7.0% of tungsten; and a total amount of Ti, Ta and Nb being not more than 0.5%. A parameter Ps represented by a formula (1) shown below is 0.6 to 1.6, $$Ps=-7\times[C]-0.1\times[Mo]+0.5\times[Al] \quad (1)$$

where [C] indicates an amount of carbon; [Mo] indicates an amount of molybdenum; and [Al] indicates an amount of aluminum, by mass percent.

10 Claims, 3 Drawing Sheets

NICKEL BASE WROUGHT ALLOY

TECHNICAL FIELD

The present invention relates to a nickel base wrought alloy.

BACKGROUND OF THE INVENTION

It is effective to elevate a combustion temperature for improving efficiency of a steam turbine and a gas turbine for power generation.

At the present time, a steam temperature of a mainstream coal-fired power plant is 550 to 600° C. A ferritic heat-resistant steel is in use as a material for a turbine or a boiler. Since the ferritic heat-resistant steel is excellent in large steel ingot manufacturability, a large wrought product exceeding 10 tons is produced and utilized in a turbine rotor shaft and a boiler piping. However, since a durable temperature of the ferritic heat-resistant steel is at most about 650° C., the ferritic heat-resistant steel can not be used at a temperature higher than about 650° C. because of insufficient high-temperature mechanical strength.

In a gas turbine, a high temperature part uses a nickel base alloy having excellent high-temperature mechanical strength.

The nickel base alloy contains a solid solution strengthening element much, such as W, Mo or Co, and a precipitation strengthening element, such as Al, Ti, Nb or Ta, and has excellent high-temperature mechanical strength. A γ' phase ($Ni_3Al$), which is a main precipitation strengthening phase, has a property that the mechanical strength increases as a temperature increases and is very effective in improving the mechanical strength characteristics at a high temperature. When an element, such as Ti, Nb or Ta, is added, the γ' phase is stabilized and can persist up to a higher temperature. Accordingly, when the nickel base alloy is to be improved in performance, it has been a main point of development how to stabilize the γ' phase.

However, as the mechanical strength increases, hot forging becomes more difficult. Thus, it becomes impossible to produce, by forging, a rotor vane which bears largest load in the turbine or engine. Accordingly, the rotor vane is produced generally by precision casting (for example, see JP-A-09-272933). In the precision casting, since a workable weight is limited, a large part like a steam turbine rotor is difficult to be produced from a conventional high mechanical strength nickel base alloy.

On the other hand, JP-A-2009-097052 discloses a nickel base alloy having an excellent hot forging property and high-temperature mechanical strength in combination, which can be obtained by selecting an alloy element. The nickel base alloy can be preferably applied to a material of a steam turbine and a gas turbine.

As a factor inhibiting a nickel base alloy from becoming a large ingot other than the hot forging property, it is poor in large steel ingot manufacturability.

As is mentioned above, a nickel base alloy is added with many strengthening elements, and these elements are prone to segregate at the time of solidification. When segregation occurs in a steel ingot, cracks generate during hot forging, and a material becomes inhomogeneous so that necessary mechanical strength can not be obtained. Accordingly, an adequate material can not be obtained. As a size of a steel ingot increases, a cooling speed and a solidifying speed become slow and it results in a condition where segregation tends to generate.

With a conventional nickel base alloy, it is difficult to produce a large wrought material exceeding 10 tons as used in a steam turbine. Although there is a method where small parts are joined by welding to produce a large part, there is concern for a welding cost and a problem of reliability of the weld portions. Accordingly, a nickel base alloy that is unlikely to generate segregation and excellent in large steel ingot manufacturability is desired.

SUMMARY OF THE INVENTION

JP-A-2009-097052 describes that high-temperature mechanical strength and a hot workability can be combined when added precipitation strengthening element is limited only to Al; and Ti, Ta, Nb and the like are not added or added at a small amount of not more than 0.5%. Ti, Ta and Nb largely distribute in a melt during solidification and generate segregation. Accordingly, an alloy designing of JP-A-2009-097052 is said to be desirable from the viewpoint of improvement in large steel ingot manufacturability, which is an object of the present invention.

However, an indispensable strengthening element Al is also an element prone to segregate although its tendency is small in comparison with Ti, Ta and Nb, and it has been problematic when a steel ingot size is increased.

An object of the present invention is to provide a nickel base alloy that can have a high-temperature mechanical strength and a hot forging property in combine and is unlikely to generate segregation and excellent in large steel ingot manufacturability, and a wrought part for a steam turbine plant therewith.

A nickel base alloy of the present invention includes, by mass, carbon: 0.001 to 0.1%, Cr: 12 to 23%, Co: 15 to 25%, Al: 3.5 to 5.0%, Mo: 4 to 12%, and W: 0.1 to 7.0%, and Ti, Ta and Nb: a total amount is not more than 0.5%, and a parameter Ps represented by formula (1) below is 0.6 to 1.6.

$$Ps=-7\times[C]-0.1\times[Mo]+0.5\times[Al] \quad (1)$$

where [C] indicates an amount of carbon; [Mo] indicates an amount of molybdenum; and [Al] indicates an amount of aluminum, by mass percent.

According to the present invention, a large wrought material that can be used in a steam turbine plant where a steam temperature exceeds 750° C. and that exceeds 10 tons can be produced.

Other objects, features and advantages of the invention will become apparent from the following description of the embodiments of the invention taken in conjunction with the accompanying drawings.

DETAILED DESCRIPTION OF THE INVENTION

Figure 1:
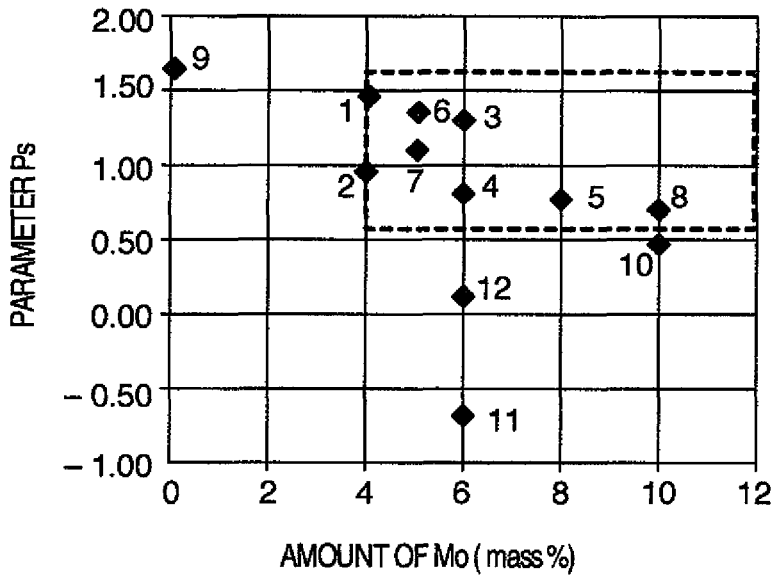
FIG. 1 is a graph showing correlation between an amount of Mo and a parameter Ps of nickel base alloys of Examples according to the present invention and Comparative examples.

The present invention relates to a nickel base alloy suitable for a large material for a high-efficiency thermal power plant and a wrought part for a steam turbine therewith.

The present inventors studied in detail the influence of the respective alloy elements on segregation by experiments and a thermodynamic calculation concerning thermal equilibrium, and they found that the segregation can be suppressed by controlling contents of Mo, W, Al, carbon and the like, and thereby, came to the invention of an alloy which is improved in large steel ingot manufacturability.

That is, the nickel base alloy of the present invention (hereinafter, also referred to as a "Ni base wrought alloy" or simply referred to as an "alloy") includes, by mass, carbon: 0.001 to 0.1%, Cr: 12 to 23%, Co: 15 to 25%, Al: 3.5 to 5.0%, Mo: 4 to 12%, W: 0.1 to 7.0%, and Ti, Ta and Nb in a total amount is not more than 0.5%, wherein a parameter Ps represented by a formula (1) shown below is 0.6 to 1.6 ($0.6 \leqq Ps \leqq 1.6$).

$$Ps = -7\times[C] - 0.1\times[Mo] + 0.5\times[Al] \quad (1)$$

where [C] indicates an amount of carbon; [Mo] indicates an amount of molybdenum; and [Al] indicates an amount of aluminum, by mass percent.

Furthermore, a nickel base alloy capable of obtaining more excellent large steel ingot manufacturability includes 5 to 8% of Mo by mass.

In the formula (1), the amount of carbon, the amount of Mo and the amount of Al respectively represent percent amounts (% by mass) of carbon, molybdenum and aluminum contained in the nickel base wrought alloy.

A nickel base alloy capable of obtaining more preferable large steel ingot manufacturability has the parameter Ps of 0.8 to 1.4.

In the present invention, when a balance between the high-temperature mechanical strength and the hot forging property is taken into consideration, it is desirable that a total amount of Mo and W is not more than 12% by mass percent ($Mo+W \leqq 12\%$ by mass).

These alloys can be used in applications for wrought parts for a steam turbine plant, such as a turbine rotor, a boiler tube, a bolt or a nut.

Here, carbon: 0.001 to 0.1% by mass means that, one alloy component, carbon (C), in the alloy is contained in an amount in the range of 0.001 to 0.1%, that is, not less than 0.001% but not more than 0.1% in relation to the mass of the nickel base alloy of the present invention. It may be expressed as 0.001 to 0.1 mass %. In this case, 0.001% and 0.1%, respectively, represent lower and upper limits, and the lower and upper limits are contained in the range of the present invention. It is true for other components. When a composition of an alloy is represented by a unit of percent (%), the unit of percent means "percent by mass" unless other unit is clearly stated.

It is necessary to inhibit generation of segregation during solidification in order to improve large steel ingot manufacturability, which is an object of the present invention.

A reason why segregation is generated is considered that a solute element is distributed at a solid-liquid interface to cause density difference in a melt.

In Table 1, results of investigation of distribution coefficients (a concentration ratio of a constituent element between in a liquid phase and in a solid phase) that show distribution tendency of elements of the nickel base alloy of the present invention are shown.

TABLE 1

Distribution coefficients of respective elements

| Element | C | Al | Cr | Co | Ni | Mo | W |
|---|---|---|---|---|---|---|---|
| Distribution coefficient | 17.1 | 1.5 | 1.1 | 1.0 | 0.9 | 1.8 | 1.1 |

An element having the distribution coefficient close to 1 is difficult to generate a concentration difference, that is, difficult to segregate. On the contrary, as the distribution coefficient is more far from 1, more easily the segregation is generated. In Table 1, carbon (C), Al and Mo have strong tendency. However, since Al is an element lighter than nickel that is a main component and Mo is an element heavier than nickel, these elements have an opposite action on density of the melt. Furthermore, carbon largely lowers a melting point of a liquid phase and thereby tends to increase density of the melt. Accordingly, by balancing elements different in the segregation tendency each other, a density difference in the melt can be controlled and thereby the segregation can be suppressed to improve large steel ingot manufacturability.

Compositional ranges of constituent elements of the nickel base alloy of the present invention and reasons for selection thereof will be shown below.

Carbon (C) dissolves in a matrix to improve tensile strength at a high temperature. It forms a carbide such as $M^1C$ (Me represents a metal element such as Ti, Ta or Nb), and $M^2{}_{23}C_6$ ($M^2$ represents a metal element such as Cr or Mo) to improve grain-boundary strength. These effects become remarkable above about 0.001%. However, when carbon is added excessively, coarse eutectic carbide is generated to result in deterioration of toughness. Accordingly, the upper limit is set at 0.1%. The content of 0.001 to 0.1% is preferable. A more preferable range is 0.03 to 0.08%.

Furthermore, carbon has a very strong tendency to distribute in a liquid phase and very strong effect in lowering a melting point to make the density of the melt larger. When carbon is added exceeding 0.1%, coarse carbide precipitates in clusters and thereby mechanical strength characteristics are deteriorated.

Al (aluminum) is an element that forms a γ' ($Ni_3Al$) phase and is an indispensable element for strengthening a γ' phase strengthening nickel base alloy. Furthermore, Al has an effect of improving oxidation resistance. When Al is insufficient, a precipitation amount of a γ' phase due to aging is small. Thus, sufficient high-temperature mechanical strength can not be obtained.

In the nickel base alloy of the present invention, since other strengthening elements Ti, Ta and Nb are small, an amount of Al of at least 3.5% is necessary to obtain sufficient mechanical strength. However, when the content of Al is excessive, a solid solution temperature becomes higher and thereby hot forging becomes difficult. Accordingly, Al is contained in the range that does not exceed 5.0%. The content of 3.5 to 5.0% is preferable and a more preferable range is 3.6 to 4.5%.

Furthermore, Al has a strong tendency to distribute in a liquid phase and an effect of lowering density of a melt. Accordingly, when Al is added exceeding 5.0%, segregation is caused, and a melting point is lowered so that cracks generate during hot working.

Mo (molybdenum) has an effect of strengthening a matrix by solid solution strengthening and improves mechanical strength at about 0.1%. However, Mo is necessary to be added at not less than 4.0% from the viewpoint of large steel ingot manufacturability. Thereby, melt density is made larger and segregation can be inhibited from occurring. However, when Mo is added exceeding 12%, a brittle detrimental phase precipitates and adversely affects a high temperature forging property and mechanical strength. Thus, the content of Mo is preferably 4.0 to 12%. A more preferable range of Mo is 5.0 to 8.0%.

Cr (chromium) is an element that forms a dense oxide film including $Cr_2O_3$ on a surface of the nickel base alloy to improve oxidation resistance and high temperature corrosion resistance. In order to utilize the nickel base alloy as a high temperature material which is aimed in the present invention, it is necessary to contain at least 12%. However, when Cr is added at more than 23%, a σ phase precipitates to deteriorate ductility and fracture toughness of the material. Accordingly, the content of Cr is in the range not exceeding 23%. The content of Cr is preferably 12 to 23% and more preferably in the range of 16 to 20%.

Co (cobalt) substitutes nickel and is dissolved in a matrix to improve high-temperature mechanical strength, and lowers a solid solution temperature of a γ' phase and thereby makes hot working easier. In the case where the amount of Al is increased to improve high-temperature mechanical strength and oxidation resistance, excellent hot workability can be maintained by adding Co at not less than 15%. When Co is added excessively, precipitation of a detrimental phase such as a σ phase or μ phase is promoted. Accordingly, the upper limit is set at 25%. The content of 15 to 25% is preferable and the content range of 17 to 23% is more preferable.

W (tungsten) has an influence on the mechanical strength very similar to that of Mo, and a matrix is strengthened by solid solution strengthening. In order to obtain sufficient mechanical strength, it is necessary to add not less than 0.1% of W. However, when the content of W exceeds 7%, growth of a hard and brittle intermetallic compound phase is promoted and a high temperature forging property is deteriorated. Thus, the content of W is preferably 0.1 to 7.0% and more preferably in the range of 2.0 to 6.0%.

Furthermore, a total amount of Mo and W is desirable to be not more than 12%. Since the lower limits of Mo and W are, respectively, 4.0% and 0.1%, a total amount of Mo and W is desirably 4.1 to 12%. A more desirable range is 5.0 to 12%.

As described above, Al has opposite effect from Mo and carbon with respect to large steel ingot manufacturability. Accordingly, elements are necessary to be selected so that the parameter Ps represented by the formula (1) satisfies the predetermined relationship.

When an alloy composition range satisfying $0.6 \leqq Ps \leqq 1.6$ is selected, large steel ingot manufacturability can be improved, which is an object of the present invention, and thereby an ingot of not less than 10 tons having no segregation can be expected. A more preferable range is $0.8 \leqq Ps \leqq 1.4$.

EXAMPLES

Examples according to the present invention will be described below.

Alloys having a weight of 10 kg and having compositions shown in Table 2 were produced with use of a vacuum induction melting furnace.

Examples 1 to 8 show materials of the present invention and Comparative Examples 1 to 4 show alloys, compositions or the parameters Ps of which are out of the ranges of the present invention. Among these, Comparative Examples 3 and 4 are practically used high mechanical strength nickel base alloys and contain much titanium.

In Table 2, values of Ps calculated by the formula (1) are also shown.

TABLE 2

Alloy compositions of samples

| | | Alloy composition (by mass %) | | | | | | | | | | |
|---|---|---|---|---|---|---|---|---|---|---|---|---|
| No. | Material | C | Al | Cr | Co | Ni | Mo | W | Ti | Ta | Nb | Ps |
| 1 | Example 1 | 0.03 | 4.1 | 17 | 22 | balance | 4 | 4 | 0 | 0 | 0 | 1.44 |
| 2 | Example 2 | 0.10 | 4.1 | 18 | 22 | balance | 4 | 4 | 0 | 0 | 0 | 0.95 |
| 3 | Example 3 | 0.03 | 4.2 | 17 | 22 | balance | 6 | 2 | 0 | 0 | 0 | 1.29 |
| 4 | Example 4 | 0.10 | 4.2 | 17 | 22 | balance | 6 | 2 | 0 | 0 | 0 | 0.80 |
| 5 | Example 5 | 0.05 | 3.8 | 16 | 20 | balance | 8 | 1 | 0.1 | 0 | 0 | 0.75 |
| 6 | Example 6 | 0.05 | 4.4 | 15.5 | 18.5 | balance | 5 | 2 | 0 | 0.1 | 0.1 | 1.35 |
| 7 | Example 7 | 0.03 | 3.6 | 20 | 20.5 | balance | 5 | 5 | 0.1 | 0 | 0.1 | 1.09 |
| 8 | Example 8 | 0.08 | 4.5 | 18 | 22 | balance | 10 | 2 | 0.2 | 0 | 0 | 0.69 |
| 9 | Comparative Example 1 | 0.05 | 4.0 | 16 | 22 | balance | 0 | 8 | 0 | 0 | 0 | 1.65 |
| 10 | Comparative Example 2 | 0.05 | 3.6 | 18 | 23 | balance | 10 | 2 | 0 | 0 | 0 | 0.45 |
| 11 | Comparative Example 3 | 0.05 | 0.5 | 20 | 20 | balance | 6 | 0 | 2.2 | 0 | 0 | −0.70 |
| 12 | Comparative Example 4 | 0.05 | 2.1 | 20 | 12 | balance | 6 | 1 | 3 | 0 | 0 | 0.10 |

FIG. 1 is a graph showing relationship between Ps and an amount of Mo. In the figure, an area surrounded by a dashed line is a range of the present invention and Examples 1 to 8 falls in the area. Comparative Examples 1 to 4 are out of the range of the present invention. In the figure, plotted reference numerals 1 to 8 indicate Examples 1 to 8 and reference numerals 9 to 12 indicate Comparative Examples 1 to 4. These reference numerals correspond to numbers (No.) in Table 2.

Examples 1 to 8 in the range of the present invention are excellent in the large steel ingot manufacturability.

After oxide films and defects on surfaces thereof were removed, the prepared alloys were hot worked into round bars of ϕ 15 mm. The round bar materials were appropriately heat-treated, and then various test pieces were sampled therefrom and subjected to characteristics evaluations. A high-temperature creep test was performed to evaluate mechanical strength. A test temperature was set at 800° C. and a test load was set at 294 MPa. The hot forging property was judged based on whether hot working can be applied or not and by measuring a solid solution temperature of a γ' phase, that is a strengthening phase, by thermal analysis. In a conventional forging apparatus, a temperature during forging is about 1000° C., and a material, γ' phase solid solution temperature of which exceeds 1000° C., is difficult to produce a large wrought material owing to large deformation resistance. In order to evaluate large steel ingot manufacturability, alloys were separately melted, while a cooling speed was controlled to generate segregation by simulation, and thereby it was evaluated how easy segregation generates. Results of various tests are summarized in Table 3.

TABLE 3

Results of various characteristics tests

| No. | Material | Result of creep test (800° C., 294 MPa) Rupture time (hours) | Rupture elongation (%) | γ' phase solid solution temperature (° C.) | Manufacturability of large steel ingot |
|---|---|---|---|---|---|
| 1 | Example 1 | 334 | 25 | 965 | no segregation |
| 2 | Example 2 | 284 | 41 | 968 | no segregation |
| 3 | Example 3 | 334 | 21 | 968 | no segregation |
| 4 | Example 4 | 267 | 28 | 971 | no segregation |
| 5 | Example 5 | 281 | 38 | 942 | no segregation |
| 6 | Example 6 | 308 | 26 | 981 | no segregation |
| 7 | Example 7 | 345 | 40 | 945 | no segregation |
| 8 | Example 8 | 278 | 35 | 978 | no segregation |
| 9 | Comparative Example 1 | 124 | 8 | 983 | slight segregation |
| 10 | Comparative Example 2 | 237 | 15 | 925 | segregation |
| 11 | Comparative Example 3 | 60 | 48 | 990 | segregation |
| 12 | Comparative Example 4 | 272 | 25 | 1052 | segregation |

Figure 2:
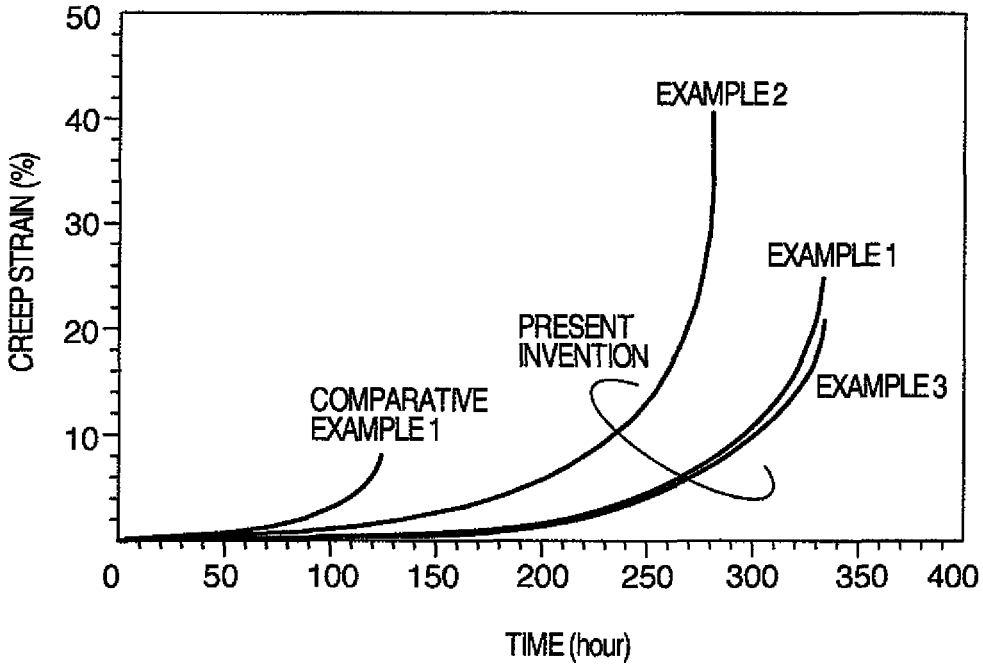
FIG. 2 is a graph showing creep strain curves of nickel base alloys of Examples according to the present invention and a Comparative example.

FIG. 2 is a graph showing one example of a creep strain curve obtained by a creep test.

In the figure, Examples 1 to 3 are superior to Comparative Example 1 in both of a creep rupture time and a creep rupture elongation.

Figure 3:
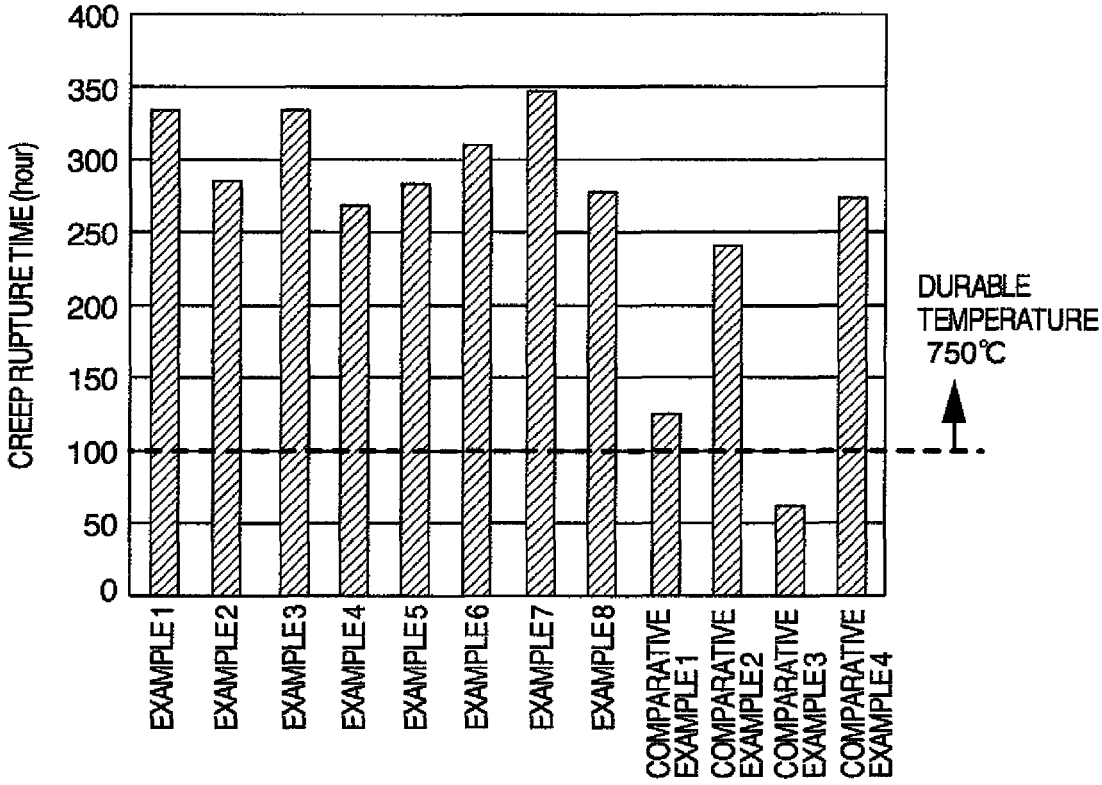
FIG. 3 is a graph showing creep rupture time of nickel base alloys of Examples according to the present invention and Comparative examples.

FIG. 3 is a graph showing a creep rupture time of the alloys.

When a rupture time of not shorter than 100 hours is attained under the test conditions, a durable temperature of not lower than 750° C. for a steam turbine material can be expected. The creep rupture times of Examples 1 to 8 are largely above 100 hours and the durable temperatures (under 100 MPa and for 100,000 hours) are estimated to be 780 to 800° C.

As to Comparative Examples 1 to 4, all materials except Comparative Example 3 attained rupture times of not shorter than 100 hours. Thus, the mechanical strength was relatively excellent. In Comparative Example 3, since the content of Al was small and a precipitation amount of a γ' phase was small at a usage temperature, sufficient mechanical strength was not obtained.

All solid solution temperatures of γ' phases of Examples 1 to 8 were not higher than 1000° C. and exhibited a very excellent hot forging property in actual hot working as well. Since the solid solution temperatures of Comparative Examples 1 to 3 were also not higher than 1000° C., there was no problem of the hot forging property. However, a round bar material of Comparative Example 4 partly showed cracks generated during hot forging. It is considered that working becomes difficult since much Ti is contained and a γ' phase is present during hot forging.

In the evaluation of large steel ingot manufacturability, there was a large difference between Examples and Comparative Examples. The large steel ingot manufacturability was evaluated by a segregation simulation test.

In Table 3, samples in which segregation was not observed by segregation simulation test are expressed by "no segregation". Samples in which segregation was observed and workability and characteristics were largely deteriorated are expressed by "segregation", and a sample that showed slight segregation is expressed by "slight segregation".

In Examples 1 to 8, segregation was not observed in all alloys. In a segregation simulation test at this time, a cooling speed is set slower than that of a material used in mechanical strength evaluation to assume a manufacturing condition for a steel ingot of 10 tons. When there is no segregation in the test, it is considered that an actual large steel ingot can be produced without segregation.

In Comparative Example 1, slight segregation was observed. When this ingot was hot forged, no crack was generated. However, there is concern that the characteristics are inhomogeneous and sufficient mechanical strength can not be obtained due to inhomogeneous composition of the alloy. In Comparative Example 2, segregation was observed. Although composition of Comparative Example 2 is close to those of Example 8, it is considered that an alloy composition tends to generate segregation because Ps is out of the range of the present invention and is deficient in the large steel ingot manufacturability. Since segregation was observed in Comparative Examples 3 and 4, it is difficult to produce a large steel ingot exceeding 10 tons.

Thus, according to the invention, an alloy can be realized that can be hot forged while maintaining a durable temperature of not lower than 750° C. used for a steam turbine and a large steel ingot of 10 tons class can be produced.

Examples of wrought parts produced with the nickel base alloy of the present invention will be described below.

Figure 4A:
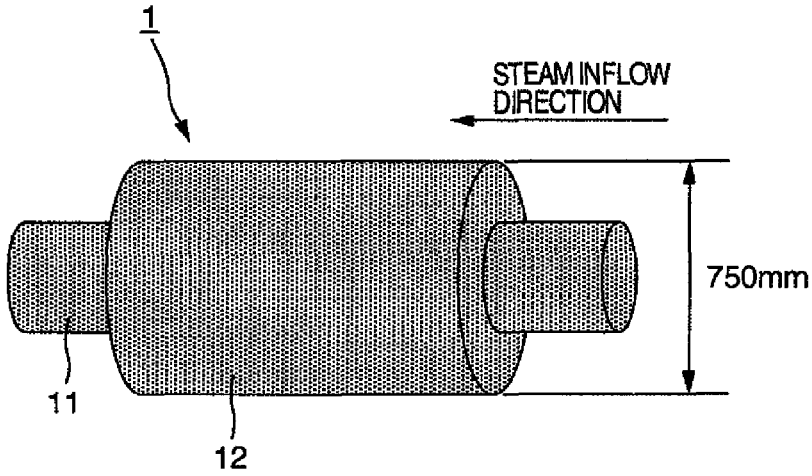
FIG. 4A is a perspective view showing an integrated turbine rotor using a nickel base alloy of the present invention.

FIGS. 4A and 43 show examples of a case where the nickel base alloy of the present invention is applied to a steam turbine rotor.

FIG. 4A shows an integrated turbine rotor where steam inflows from a right side of the figure to a left side thereof.

In the figure, an integrated turbine rotor 1 is constituted of a shaft 11 and a trunk 12. The shaft 11 and the trunk 12 are made of the nickel base alloy of the present invention. An outer diameter of the trunk 12 is 750 mm.

Since the nickel base alloy of the present invention is excellent in large steel ingot manufacturability and can be hot forged, the nickel base alloy can be used as an integrated turbine rotor as is shown in FIG. 4A.

Therefore, a steam temperature can be elevated to not lower than 750° C., and thereby an improvement in power generation efficiency can be expected.

Figure 4B:
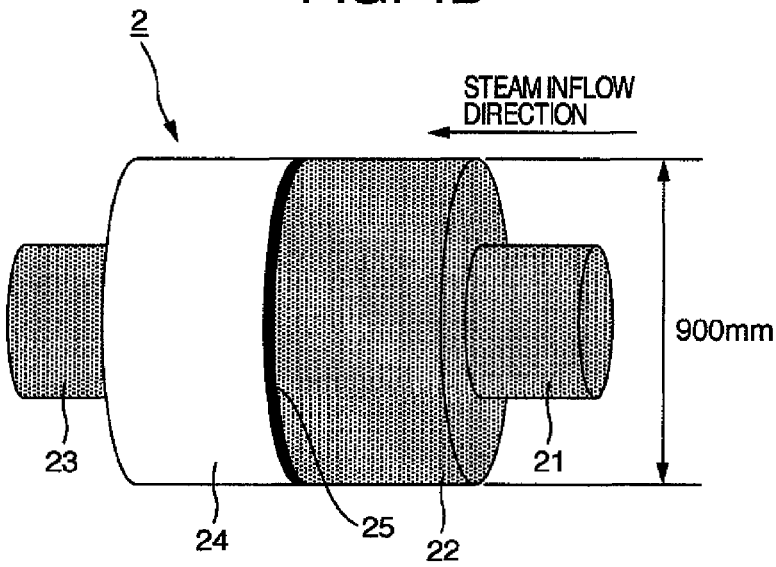
FIG. 4B is a perspective view showing a weld type turbine rotor using a nickel base alloy of the present invention.

FIG. 4B shows a weld type turbine rotor.

In the figure, a weld type turbine rotor 2 is constituted by jointing a first shaft 21 and a first trunk 22 with a second shaft 23 and a second trunk 24 at a weld portion 25. The first shaft 21 and the first trunk 22 are made of the nickel base alloy of the present invention. The second shaft 23 and the second trunk 24 are made of ferritic heat-resistant steel (ferritic steel) or a nickel base alloy. Outer diameters of the first trunk 22 and the second trunk 24 are 900 mm.

As shown in the figure, when a turbine is enlarged to realize higher output, the nickel base alloy of the present invention may be also used in a weld type rotor. In this case, the materials of Examples may be welded with each other. However, as shown in FIG. 4B, it is possible to be weld with different materials such as a ferritic heat resistant steel on a lower temperature side on a downstream in a steam inflow direction.

Figure 5:
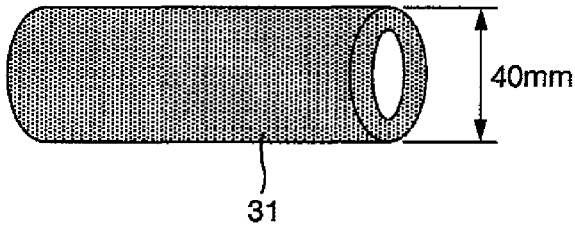
FIG. 5 is a perspective view showing a boiler piping using a nickel base alloy of the present invention.

FIG. 5 is an example of a case where the nickel base alloy of the present invention is applied to a boiler piping of a steam turbine plant.

In the figure, a boiler piping 31 uses the nickel base alloy according the invention and having an outer diameter of 40 mm.

In order to elevate a temperature of main steam introduced into a turbine up to 700° C., main steam has to be heated up to 750° C. in the boiler. Accordingly, a durable temperature of a piping material has to be not lower than 750° C. However, when the nickel base alloy of the present invention is used, a turbine plant, in which main steam temperature is 700° C., can be realized. The boiler piping 31 is joined by welding and a crack tends to start at a weld portion, compared with a base material, due to weld defects and thermal influence. Since the nickel base alloy of the present invention can provide a larger raw material compared with a conventional alloy, weld portions can be reduced and thereby reliability can be improved.

Figure 6:
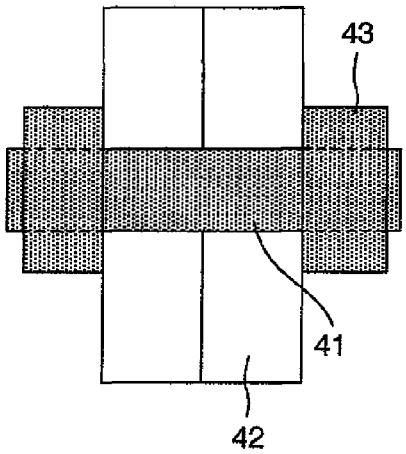
FIG. 6 is a side view showing a casing bolt using a nickel base alloy of the present invention.

FIG. 6 is an example in a case where the nickel base alloy of the present invention is used as a bolt and a nut of a turbine casing.

In the figure, a turbine casing 42 is fastened with a bolt 41 and a nut 43. The bolt 41 and the nut 43 use the nickel base alloy of the present invention. The turbine casing 42 uses a NiCrMo wrought material and the like.

The turbine casing 42 is a pressure-resistant part and generally integrated one by bonding, with use of the bolt 41 and the nut 43, forged parts which are separately produced.

When a temperature goes up, a conventional wrought material undergoes creep deformation to loosen a bolt and a nut and thereby a problem of steam leakage is caused. However, the nickel base alloy of the present invention has high mechanical strength, and thus, the creep deformation is not caused and a bolt and a nut do not loosen.

According to the invention, a large wrought material of not less than 10 tons can be produced, the mechanical strength of not less than 100 MPa in the creep rupture strength at 750° C. and for 100,000 hours can be obtained. When the large wrought material is used as a steam turbine and gas turbine material, higher temperature and higher efficiency can be obtained.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A nickel base alloy comprising, by mass
0.001 to 0.1% of carbon
12 to 23% of chromium
18.5 to 25% of cobalt
3.5 to 5.0% of aluminum
4 to 10% of molybdenum
0.1 to 7.0% of tungsten and
not more than 0.5% in a total amount of titanium, tantalum and niobium;
wherein a total amount of molybdenum and tungsten is 4.1 to 12% by mass; and
wherein a parameter Ps represented by a formula (I) shown below is 0.6 to 1.6, $$Ps=-7\times[C]-0.1\times[Mo]+0.5\times[Al] \quad (1)$$

where [C] indicates an amount of carbon; [Mo] indicates an amount of molybdenum; and [Al] indicates an amount of aluminum, by mass percent.

2. The nickel base alloy according to claim 1, wherein the nickel base alloy contains 5 to 8% of molybdenum by mass.

3. The nickel base alloy according to claim 1, wherein the parameter Ps is 0.8 to 1.4.

4. A wrought part for a steam turbine plant, using the nickel base alloy according to claim 1.

5. The wrought part according to claim 4, wherein the wrought part is a steam turbine rotor, a boiler tube, a bolt or a nut for a steam turbine plant.

6. The nickel base alloy according to claim 1, wherein a total amount of molybdenum and tungsten is 5 to 12% by mass.

7. A nickel base alloy comprising, by mass
0.03 to 0.08% of carbon
16 to 20% of chromium
17 to 23% of cobalt
3.6 to 4.5% of aluminum
5 to 8% of molybdenum
2 to 6% of tungsten and
not more than 0.5% in a total amount of titanium, tantalum and niobium;
wherein a total amount of molybdenum and tungsten is not more than 12% by mass; and
wherein a parameter Ps represented by a formula (I) shown below is 0.6 to 1.6, $$Ps=-7\times[C]-0.1\times[Mo]+0.5\times[Al] \quad (1)$$

where [C] indicates an amount of carbon; [Mo] indicates an amount of molybdenum; and [Al] indicates an amount of aluminum, by mass percent.

8. The nickel base alloy according to claim 7, wherein the parameter Ps is 0.8 to 1.4.

9. A wrought part for a steam turbine plant, using the nickel base alloy according to claim 7.

10. The wrought part according to claim 9, wherein the wrought part is a steam turbine rotor, a boiler tube, a bolt or a nut for a steam turbine plant.

* * * * *